US010943518B2

(12) United States Patent
Su et al.

(10) Patent No.: US 10,943,518 B2
(45) Date of Patent: Mar. 9, 2021

(54) TIMING CONTROL CIRCUIT AND OPERATING METHOD THEREOF

(71) Applicant: Novatek Microelectronics Corp., Hsinchu (TW)

(72) Inventors: Yu-Hung Su, Hsinchu (TW); Cheng-Yu Tsai, Hsinchu (TW); Jung-Chieh Cheng, Changhua County (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 16/527,054

(22) Filed: Jul. 31, 2019

(65) Prior Publication Data

US 2021/0035479 A1 Feb. 4, 2021

(51) Int. Cl.
*G09G 3/20* (2006.01)

(52) U.S. Cl.
CPC ..... *G09G 3/20* (2013.01); *G09G 2310/027* (2013.01); *G09G 2310/0267* (2013.01); *G09G 2310/08* (2013.01)

(58) Field of Classification Search
CPC .. H04N 5/04; H03K 7/06; H03K 3/84; H04K 3/825; G09G 3/2932; G09G 3/20; G09G 2310/027; G09G 2310/0267; G09G 2310/08; G09G 3/2018; G09G 5/18; G06F 3/1423
See application file for complete search history.

(56) References Cited

U.S. PATENT DOCUMENTS

2001/0024179 A1* 9/2001 Nakamura ..... G09G 3/2932 345/60
2004/0196212 A1* 10/2004 Shimizu ..... G09G 5/18 345/3.1
2005/0264553 A1* 12/2005 Chia ..... G06F 3/1423 345/213
2007/0063755 A1* 3/2007 Gilliland ..... H03K 7/06 327/291
2010/0141317 A1* 6/2010 Szajnowski ..... H03K 3/84 327/160
2012/0163417 A1* 6/2012 Mori ..... H04K 3/825 375/135
2018/0090105 A1* 3/2018 Suzuki ..... H04N 5/04
2018/0182278 A1* 6/2018 Kim ..... G09G 3/2018

* cited by examiner

*Primary Examiner* — Richard J Hong
(74) *Attorney, Agent, or Firm* — JCIPRNET

(57) ABSTRACT

A timing control circuit and an operating method thereof are provided. The timing control circuit includes a first clock generating circuit, a second clock generating circuit and a control timing generating circuit. The control timing generating circuit is coupled to the first clock generating circuit to receive a first clock signal. The control timing generating circuit is coupled to the second clock generating circuit to receive a second clock signal. The control timing generating circuit starts timing from a first reference time point according to the first clock signal for determining a second reference time point. The control timing generating circuit starts timing from the second reference time point according to the second clock signal for determining a time point of a trailing edge of a current line pulse of a scan reference signal, wherein the current line pulse corresponds to a current scan line of a display panel.

16 Claims, 4 Drawing Sheets

TIMING CONTROL CIRCUIT AND OPERATING METHOD THEREOF

BACKGROUND OF THE INVENTION

1. Field of the Invention

The invention relates to a display device, and particularly relates to a timing control circuit and an operating method thereof.

2. Description of Related Art

A timing control circuit may receive video data streaming from a previous circuit, and generate a video frame to be displayed on a display panel based on the video data streaming. Under the control exerted by the timing control circuit, a source driver may drive a plurality of data lines (source lines) of the display panel according to the video frame. The timing control circuit may generate a scan reference signal based on the video data streaming. A gate driver may scan/drive a plurality of scan lines (gate lines) of the display panel according to the scan reference signal.

In general, the timing control circuit is considered as one of the sources of electromagnetic interference (EMI). To reduce EMI, a spectrum-spreading function of the timing control circuit may be activated. That is, the timing control circuit may generate the scan reference signal according to a spread spectrum clock signal, so that the energy of the scan reference signal is distributed in different frequencies of a spectrum. In order to effectively reduce EMI, the extent to which the spectrum is spread needs to be increased. In other words, the extent of frequency drift of the scan reference signal needs to be increased.

When the frequency of the scan reference signal is drifting (e.g., activating the spread spectrum function for frequency drifting), the phase of the driving signal for the scan lines of the display panel may become unstable. When the phase of the driving signal for the scan lines is unstable, the driving signal for the scan lines may be unable to synchronize with the driving signal for the data lines of the display panel. If the driving signal for the scan lines and the driving signal for the data lines do not synchronize with each other, issues such as waving, inconsistent panel charging ratios, etc., may occur in the display panel. Here, "inconsistent panel charging ratios" indicates that the charging times of pixel circuits at different regions of the display panel are different from each other. If the charging times are not stable (different), the brightness levels in different regions of the display panel may differ, or even the frame cannot be properly displayed. Currently, waving may be avoided by tuning down the degree of spectrum spreading. However, tuning down the degree of spectrum spreading may result in EMI.

It should be noted that the contents of the section of "Description of Related Art" is used for facilitating the understanding of the invention. A part of the contents (or all of the contents) disclosed in the section of "Description of Related Art" may not pertain to the conventional technology known to the persons with ordinary skilled in the art. The contents disclosed in the section of "Description of Related Art" do not represent that the contents have been known to the persons with ordinary skilled in the art prior to the filing of this invention application.

SUMMARY OF THE INVENTION

The invention provides a timing control circuit and an operating method thereof for generating a scan reference signal.

An embodiment of the invention provides a timing control circuit for controlling a display panel. The timing control circuit includes a first clock generating circuit, a second clock generating circuit and a control timing generating circuit. The first clock generating circuit is configured to generate a first clock signal. The second clock generating circuit is configured to generate a second clock signal different from the first clock signal. The control timing generating circuit is coupled to the first clock generating circuit to receive a first clock signal. The control timing generating circuit is coupled to the second clock generating circuit to receive a second clock signal. The control timing generating circuit is configured to generate a scan reference signal. The control timing generating circuit starts timing from a first reference time point according to the first clock signal for determining a second reference time point. The control timing generating circuit starts timing from the second reference time point according to the second clock signal for determining a time point of a trailing edge of a current line pulse of a scan reference signal. The current line pulse corresponds to a current scan line of a display panel.

An embodiment of the invention provides an operating method of a timing control circuit. The operating method includes: generating a first clock signal by a first clock generating circuit; generating a second clock signal different from the first clock signal by a second clock generating circuit; starting timing from a first reference time point by a control timing generating circuit according to the first clock signal, so as to determine a second reference time point; starting timing from the second reference time point by the control timing generating circuit according to the second clock signal, so as to determine a time point of a trailing edge of a current line pulse of a scan reference signal, wherein the current line pulse corresponds to a current scan line of a display panel; and generating the scan reference signal by the control timing generating circuit.

Based on the above, the first clock signal and the second clock signal different from each other may be used in the timing control circuit and the operating method thereof according to the embodiments of the invention. For example, in some embodiments, the first clock signal may be a spread spectrum clock signal, and the second clock signal may be a non-spread spectrum clock signal. The control timing generating circuit starts timing from the first reference time point according to the first clock signal for determining a second reference time point. The control timing generating circuit starts timing from the second reference time point according to the second clock signal, so as to determine the time point of the trailing edge of the current line pulse of the scan reference signal. Therefore, the trailing edge of the pulse of the scan reference signal may match the valid data period of the data line of the display panel, thereby alleviating waving, inconsistent charging ratios, etc., in the display panel.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
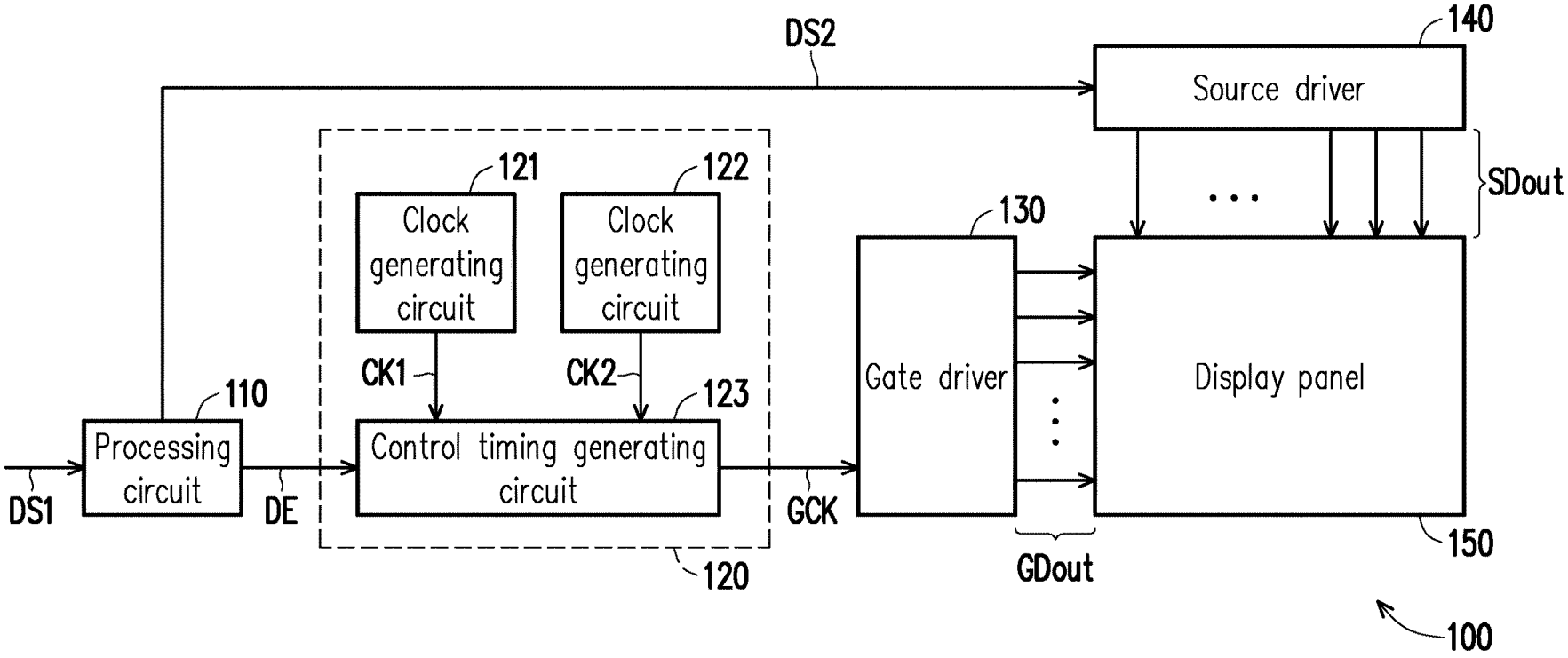
FIG. 1 is a schematic circuit block diagram of a display device according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

The term "couple (or connect)" throughout the specification (including the claims) of this application encompasses any direct or indirect connection means. For example, if the disclosure describes a first apparatus being coupled (or connected) to a second apparatus, then it should be interpreted that the first apparatus can be directly connected to the second apparatus, or the first apparatus can be indirectly connected to the second apparatus through other devices or by a certain connection means. In addition, terms such as "first" and "second" mentioned throughout the specification (including the claims) of this application are only for naming the elements or distinguishing different embodiments or scopes and are not intended to limit the upper limit or the lower limit of the number of the elements or intended to limit sequences of the elements. Moreover, elements/components/steps with same reference numerals represent same or similar parts in the drawings and embodiments. Elements/components/steps with the same reference numerals in different embodiments may be referenced to the related description.

FIG. 1 is a schematic circuit block diagram of a display device 100 according to an embodiment of the invention. The display device 100 shown in FIG. 1 includes a processing circuit 110, a timing control circuit 120, a gate driver 130, a source driver 140, and a display panel 150. The embodiment does not intend to limit the implementing details of the display panel 150. For example, based on the design needs, the display panel 150 may be a liquid crystal display (LCD) panel or other panels.

Based on the design needs, the processing circuit 110, the timing control circuit 120, the gate driver 130, and the source driver 140 may be disposed in the same or different integrated circuits. For example, in some embodiments, the processing circuit 110 and the timing control circuit 120 may be disposed in a first integrated circuit, and the gate driver 130 and the source driver 140 may be disposed in a second integrated circuit. In some other embodiments, the processing circuit 110, the timing control circuit 120, and the gate driver 130 may be disposed in a first integrated circuit, and the source driver 140 may be disposed in a second integrated circuit. In still some other embodiments, the processing circuit 110 and the timing control circuit 120 may be disposed in a first integrated circuit, the gate driver 130 may be disposed in a second integrated circuit, and the source driver 140 may be disposed in a third integrated circuit. In yet some other embodiments, the gate driver 130 and/or the source driver 140 may be disposed on the display panel 150.

The processing circuit 110 may receive a video data streaming DS1 from a previous circuit (not shown). The processing circuit 110 may obtain a video frame DS2 from the video data streaming DS1 and provide the video frame DS2 to the source driver 140. The video frame DS2 includes a plurality of lines (scan lines), each including a plurality of pixel data. According to the video frame DS2, the source driver 140 may output a driving signal SDout to a plurality of data lines (source lines, not shown) of the display panel 150. However, the embodiment does not intend to limit the implementing details of the source driver 140. For example, based on the design needs, the source driver 140 may be a conventional source driver or other source drivers.

A data enabling signal DE output by the processing circuit 110 may indicate time intervals of the lines of the video frame DS2. For example, the data enabling signal DE has a plurality of pulses, and the width and the phase of each pulse may represent the time width and the phase of a corresponding line (scan line) in the video frame DS2. The embodiment does not intend to limit the implementing details of the processing circuit 110. For example, based on the design needs, the processing circuit 110 may be a conventional video processing circuit or other video processing circuits.

The timing control circuit 120 is coupled to the processing circuit 110 to receive the data enabling signal DE. The timing control circuit 120 may generate a scan reference signal GCK according to the phase of the data enabling signal DE. The gate driver 130 is coupled to the timing control circuit 120 to receive the scan reference signal GCK. According to the scan reference signal GCK, the gate driver 130 may output a driving signal GDout to a plurality of scan lines (gate lines, not shown) of the display panel 150. The embodiment does not intend to limit the implementing details of the gate driver 130. For example, based on the design needs, the gate driver 130 may be a conventional gate driver or other gate drivers.

In the embodiment shown in FIG. 1, the timing control circuit 120 includes a clock generating circuit 121, a clock generating circuit 122, and a control timing generating circuit 123. The clock generating circuit 121 may generate a clock signal CK1, and the clock generating circuit 122 may generate a clock signal CK2 (different from the clock signal CK1). In some embodiments, the clock signal CK1 may be a spread spectrum clock signal (or other frequency drifting clock signals), and the clock signal CK2 may be a non-spread spectrum clock signal. The non-spread spectrum clock signal refers to a clock signal having a fixed frequency.

Figure 2:
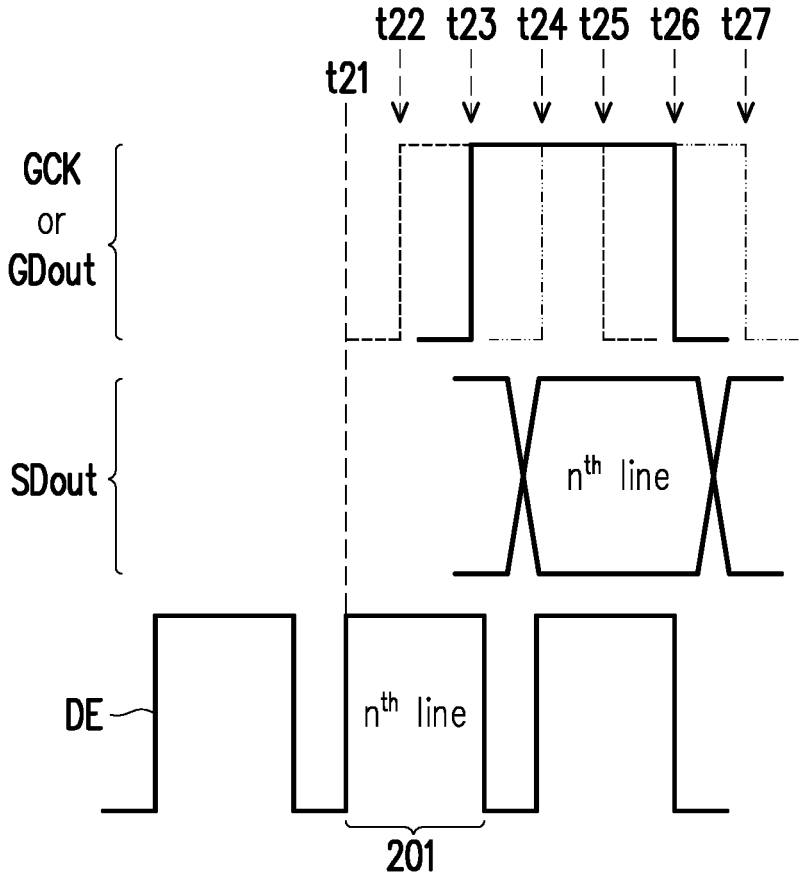
FIG. 2 is a schematic diagram illustrating signal timing according to an embodiment.

FIG. 2 is a schematic diagram illustrating signal timing according to an embodiment. Referring to FIGS. 1 and 2, FIG. 2 shows a schematic timing diagram of the scan reference signal GCK (or the driving signal GDout), the driving signal SDout, and the data enabling signal DE of FIG. 1 in a scenario assuming that the timing control circuit 120 shown in FIG. 1 does not have the clock generating circuit 122 and the clock signal CK2. The control timing generating circuit 123 is coupled to the processing circuit 110 to receive the data enabling signal DE. Each of a plurality of pulses of the data enabling signal DE serves to indicate the timing of a line having a plurality of pixel data. For example, a pulse 201 shown in FIG. 2 may indicate the timing of the $n^{th}$ line (scan line) in the video frame DS2, wherein n is an integer. It is assumed that the $n^{th}$ line corresponds to a current scan line of the display panel 150.

The control timing generating circuit 123 is coupled to the clock generating circuit 121 to receive the clock signal CK1.

The control timing generating circuit 123 may generate the scan reference signal GCK to the gate driver 130. In addition, the control timing generating circuit 123 adopts the time point of the edge of the current pulse of the data enabling signal DE (e.g., a time point t21 of the rising edge of the pulse 201 shown in FIG. 2) as a first reference time point. The control timing generating circuit 123 starts timing from the first reference time point (the time point t21) according to the clock signal CK1, so as to determine the time point of the leading edge (e.g., the rising edge) of the current line pulse of the scan reference signal GCK. Since the clock signal CK1 is a spread spectrum signal, the time point of the leading edge of the current line pulse of the scan reference signal GCK may be time points t22, t23, t24 or other time points shown in FIG. 2. The current line pulse of the scan reference signal GCK shown in FIG. 2 corresponds to a current scan line of the display panel 150.

The control timing generating circuit 123 may further start timing from the first reference time point (the time point t21) according to the clock signal CK1, so as to determine the time point of the trailing edge (e.g., the falling edge) of the current line pulse of the scan reference signal GCK. Since the clock signal CK1 is a spread spectrum signal, the time point of the trailing edge of the current line pulse of the scan reference signal GCK may be time points t25, t26, t27, or other time points shown in FIG. 2. When the phase of the trailing edge (e.g., the falling edge) of the scan reference signal GCK (or the driving signal GDout) is unstable, the charging times of pixel circuits at different positions may be inconsistent, which leads to waving, inconsistent panel charging ratios, etc., in the display panel 150.

Figure 3:
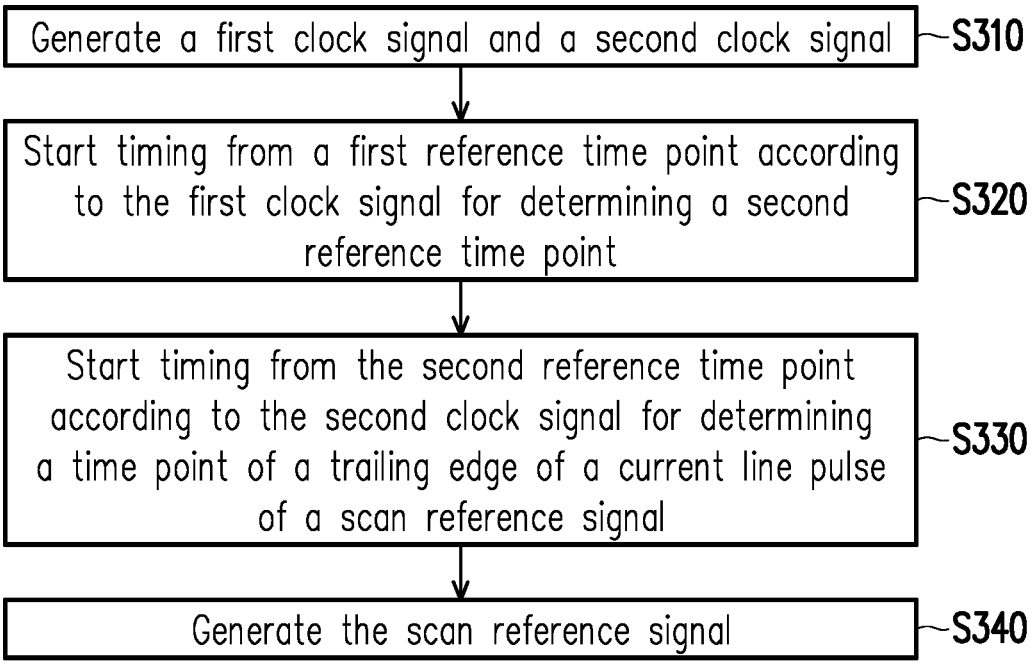
FIG. 3 is a schematic flowchart illustrating an operating method of a display device according to an embodiment of the invention.

FIG. 3 is a schematic flowchart illustrating an operating method of the display device 100 according to an embodiment of the invention. Referring to FIGS. 1 and 3, the embodiment shown in FIG. 3 assumes a scenario in which the timing control circuit 120 has the clock generating circuit 122 and the clock signal CK2. The control timing generating circuit 123 is coupled to the clock generating circuit 122 to receive the clock signal CK2. The control timing generating circuit 123 is coupled to the clock generating circuit 121 to receive the clock signal CK1. At Step S310, the clock generating circuit 121 generates the clock signal CK1, and the clock generating circuit 122 generating the clock signal CK2 different from the clock signal CK1.

Figure 4:
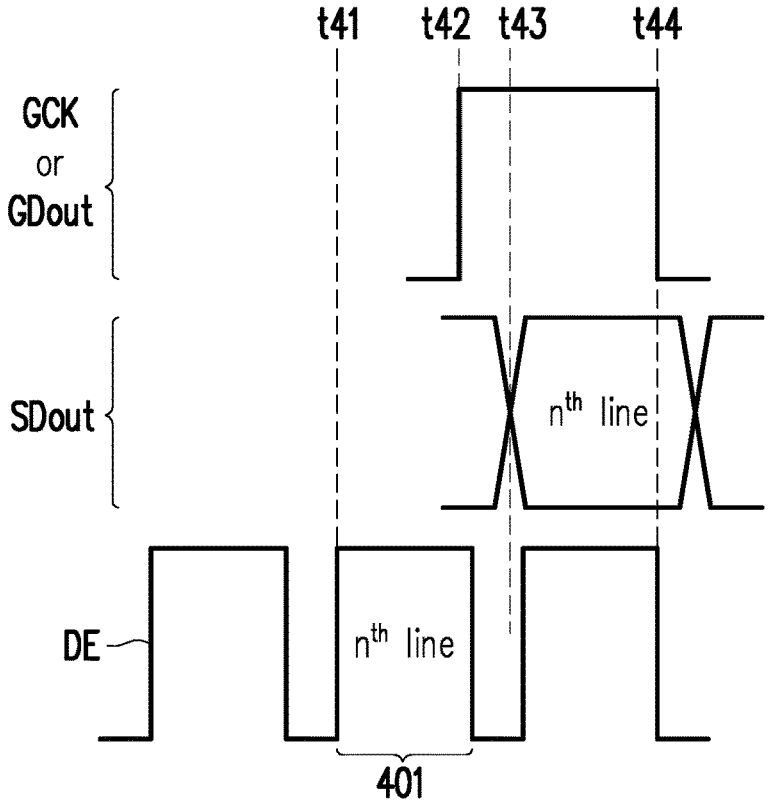
FIG. 4 is a schematic diagram illustrating timing of signals shown in FIG. 1 according to an embodiment of the invention.

FIG. 4 is a schematic diagram illustrating timing of signals shown in FIG. 1 according to an embodiment of the invention. Referring to FIGS. 1, 3, and 4, FIG. 4 shows a schematic timing diagram of the scan reference signal GCK (or the driving signal GDout), the driving signal SDout, and the data enabling signal DE of FIG. 1 in a scenario assuming that the timing control circuit 120 shown in FIG. 1 has the clock generating circuit 122 and the clock signal CK2. The control timing generating circuit 123 is coupled to the processing circuit 110 to receive the data enabling signal DE. Each of a plurality of pulses of the data enabling signal DE serves to indicate the timing of a line having a plurality of pixel data. For example, a pulse 401 shown in FIG. 4 may indicate the timing of the $n^{th}$ line (scan line) in the video frame DS2, wherein n is an integer. It is assumed that the $n^{th}$ line corresponds to a current scan line of the display panel 150.

The control timing generating circuit 123 adopts the time point of the edge of the current pulse of the data enabling signal DE as the first reference time point. For example, the control timing generating circuit 123 may adopt a time point t41 of the rising edge of the pulse 401 shown in FIG. 4 as the first reference time point. The control timing generating circuit 123 starts timing from the first reference time point (the time point t41) according to the clock signal CK1, so as to determine a time point t42 of the leading edge (e.g., the rising edge) of the current line pulse of the scan reference signal GCK. The current line pulse of the scan reference signal GCK shown in FIG. 4 corresponds to a current scan line of the display panel 150.

At Step S320, the control timing generating circuit 123 may further start timing from the first reference time point (the time point t41) according to the clock signal CK1, so as to determine a second reference time point t43. The time duration from the first reference time point (the time point t41) to the second reference time point t43 may be determined based on the design needs. For example, the second reference time point t43 may correspond to the time point of the leading edge of a valid data period of a data line of the display panel 150. Taking the timing diagram shown in FIG. 4 as an example, the second reference time point t43 may correspond to the leading edge time point of the valid data period of the $n^{th}$ scan line (the current scan line) of the driving signal SDout.

At Step S330, the control timing generating circuit 123 may start timing from the second reference time point t43 according to the clock signal CK2, so as to determine a time point t44 of the trailing edge (e.g., the falling edge) of a current line pulse of the scan reference signal GCK. The time duration from the second reference time point t43 to the time point t44 may be determined based on the design needs. For example, the time point t44 of the trailing edge of the current line pulse of the scan reference signal GCK falls within a valid data period of a data line (e.g., falling within the period of the $n^{th}$ scan line of the driving signal SDout). At Step S340, the control timing generating circuit 123 may generate the scan reference signal GCK to the gate driver 130. Since the clock signal CK2 is a clock signal having a fixed frequency, the drift amount of the trailing edge phase (the time point t44) of the current line pulse of the scan reference signal GCK may be effectively reduced. In other words, the charging times of pixel circuits at different positions may tend to be consistent. Accordingly, issues such as waving, inconsistent panel charging ratios, etc., may be effectively alleviated in the display panel 150.

Figure 5:
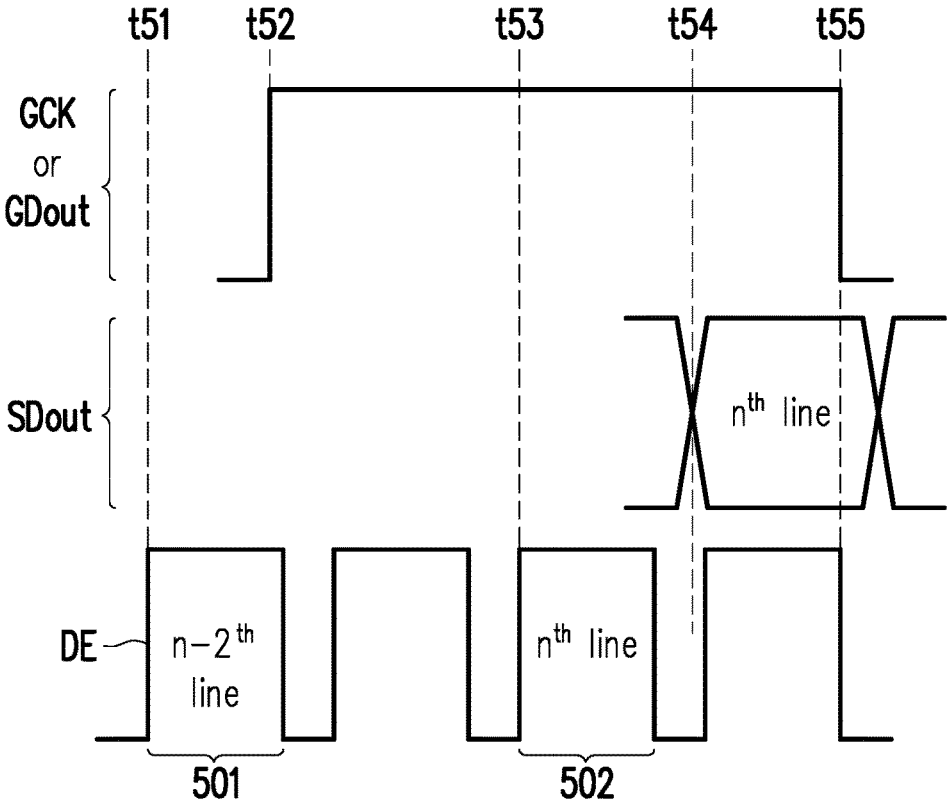
FIG. 5 is a schematic diagram illustrating timing of signals shown in FIG. 1 according to another embodiment of the invention.

FIG. 5 is a schematic diagram illustrating timing of signals shown in FIG. 1 according to another embodiment of the invention. Referring to FIGS. 1 and 5, FIG. 5 shows a schematic timing diagram of the scan reference signal GCK (or the driving signal GDout), the driving signal SDout, and the data enabling signal DE of FIG. 1 in a scenario assuming that the timing control circuit 120 shown in FIG. 1 has the clock generating circuit 122 and the clock signal CK2. A previous pulse 501 shown in FIG. 5 may indicate the timing of the $n\text{-}2^{th}$ line (scan line) in the video frame DS2, and a current pulse 502 shown in FIG. 5 may indicate the timing of the $n^{th}$ line (scan line) in the video frame DS2. Here, it is assumed that the $n^{th}$ line corresponds to the current scan line of the display panel 150, and the $n\text{-}2^{th}$ line corresponds to a previous scan line of the display panel 150.

According to the clock signal CK1, the control timing generating circuit 123 starts timing from a time point t51 of the edge of the previous pulse 501 of the data enabling signal DE to determine a time point t52 of the leading edge (e.g., the rising edge) of the current line pulse of the scan reference signal GCK. The control timing generating circuit 123 adopts a time point t53 of the edge of the current pulse 502 of the data enabling signal DE as the first reference time point. The control timing generating circuit 123 starts timing from the first reference time point (the time point t53)

according to the clock signal CK1, so as to determine a second reference time point t54. The time duration from the first reference time point (the time point t53) to the second reference time point t54 may be determined based on the design needs. For example, the second reference time point t54 may correspond to the time point of the leading edge of a valid data period of a data line of the display panel 150. Taking the timing diagram shown in FIG. 5 as an example, the second reference time point t54 may correspond to the leading edge time point of the valid data period of the $n^{th}$ scan line (the current scan line) of the driving signal SDout.

The control timing generating circuit 123 may start timing from the second reference time point t54 according to the clock signal CK2, so as to determine a time point t55 of the trailing edge (e.g., the falling edge) of a current line pulse of the scan reference signal GCK. The time duration from the second reference time point t54 to the time point t55 may be determined based on the design needs. For example, the time point t55 of the trailing edge of the current line pulse of the scan reference signal GCK falls within a valid data period of a data line (e.g., falling within the period of the $n^{th}$ scan line of the driving signal SDout). Since the clock signal CK2 is a clock signal having a fixed frequency, the drift amount of the trailing edge phase (the time point t55) of the current line pulse of the scan reference signal GCK may be effectively reduced. In other words, the charging times of pixel circuits at different positions may tend to be consistent. Accordingly, issues such as waving, inconsistent panel charging ratios, etc., may be effectively alleviated in the display panel 150.

Based on different design needs, the blocks of the processing circuit 110 and/or the timing control circuit 120 may be realized as hardware, firmware, software (i.e., programs), or a combination of more than one of the aforementioned.

In the case of hardware, the blocks of the processing circuit 110 and/or the timing control circuit 120 may be realized in logic circuits of an integrated circuit. Relevant functions of the processing circuit 110 and/or the timing control circuit 120 may be realized in the hardware by using hardware description languages (e.g., Verilog HDL, or VHDL) or other suitable programming languages. For example, relevant functions of the processing circuit 110 and/or the timing control circuit 120 may be realized as one or more controllers, microcontrollers, microprocessors, application-specific integrated circuits (ASICs), digital signal processors (DSPs), field programmable gate arrays (FPGAs), and/or various logic blocks, modules, and circuits in other processors.

In the case of software and/or firmware, relevant functions of the processing circuit 110 and/or the timing control circuit 120 may be realized as programming codes. For example, conventional programming languages (e.g., C, C++, or assembly languages) or other suitable programming languages may serve to realize the processing circuit 110 and/or the timing control circuit 120. The programming codes may be recorded/stored in a recording medium. The recording medium includes, for example, a read only memory (ROM), a storage device, and/or a random access memory (RAM). A computer, a central processing unit (CPU), a controller, a microcontroller, or a microprocessor may retrieve the programming codes from the recording medium and execute the programming codes, thereby achieving relevant functions. As the recording medium, a "non-transitory computer readable medium", such as a tape, a disk, a card, a semiconductor memory, a programmable logic circuit, etc., may be adopted. Besides, the programs may also be provided to the computer (or CPU) via an arbitrary transmission medium (a communication network, broadcasting waves, etc.). The communication network is, for example, the Internet, wired communication, wireless communication, or other communication media.

In view of the foregoing, in the timing control circuit 120 and the operating method thereof according to the embodiments of the invention, the clock signal CK1 and the clock signal CK2 different from each other may be used. For example, in some embodiments, the clock signal CK1 may be a spread spectrum clock signal, and the clock signal CK2 may be a non-spread spectrum clock signal. The control timing generating circuit 123 starts timing from the first reference time point according to the clock signal CK1 for determining the second reference time point. The control timing generating circuit 123 starts timing from the second reference time point according to the clock signal CK2, so as to determine the time point of the trailing edge of the current line pulse of the scan reference signal GCK. Therefore, the trailing edge of the pulse of the scan reference signal GCK may match the valid data period of the data line of the display panel 150 (i.e., matching the timing of the current scan line), thereby alleviating waving, inconsistent charging ratios, etc., in the display panel 150.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A timing control circuit, adapted to control a display panel, wherein the timing control circuit comprises:

a first clock generating circuit, configured to generate a first clock signal;

a second clock generating circuit, configured to generate a second clock signal different from the first clock signal; and a control timing generating circuit, coupled to the first clock generating circuit to receive the first clock signal and coupled to the second clock generating circuit to receive the second clock signal, wherein the control timing generating circuit is configured to generate a scan reference signal, the control timing generating circuit starts timing from a first reference time point according to the first clock signal for determining a second reference time point, the control timing generating circuit starts timing from the second reference time point according to the second clock signal for determining a time point of a trailing edge of a current line pulse of the scan reference signal, and the current line pulse corresponds to a current scan line of the display panel.

2. The timing control circuit as claimed in claim 1, wherein the first clock signal is a spread spectrum clock signal, and the second clock signal is a non-spread spectrum clock signal.

3. The timing control circuit as claimed in claim 2, wherein the non-spread spectrum clock signal is a clock signal having a fixed frequency.

4. The timing control circuit as claimed in claim 1, wherein the control timing generating circuit adopts a time point of an edge of a current pulse of a data enabling signal as the first reference time point, and each of a plurality of pulses of the data enabling signal is adopted to indicate a timing of a line having a plurality of pixel data.

5. The timing control circuit as claimed in claim 4, wherein the control timing generating circuit starts timing from the first reference time point according to the first clock signal, so as to determine a time point of a leading edge of the current line pulse of the scan reference signal.

6. The timing control circuit as claimed in claim 4, wherein the control timing generating circuit starts timing from a time point of an edge of a prior pulse of the data enabling signal, so as to determine a time point of a leading edge of the current line pulse of the scan reference signal.

7. The timing control circuit as claimed in claim 1, wherein the second reference time point corresponds to a time point of a leading edge of a valid data period of a data line of the display panel.

8. The timing control circuit as claimed in claim 7, wherein the time point of the trailing edge of the current line pulse falls within the valid data period of the data line.

9. An operating method for a timing control circuit, comprising:

generating a first clock signal by a first clock generating circuit;

generating a second clock signal different from the first clock signal by a second clock generating circuit;

starting timing from a first reference time point by a control timing generating circuit according to the first clock signal, so as to determine a second reference time point;

starting timing from the second reference time point by the control timing generating circuit according to the second clock signal, so as to determine a time point of a trailing edge of a current line pulse of a scan reference signal, wherein the current line pulse corresponds to a current scan line of a display panel; and generating the scan reference signal by the control timing generating circuit.

10. The operating method as claimed in claim 9, wherein the first clock signal is a spread spectrum clock signal, and the second clock signal is a non-spread spectrum clock signal.

11. The operating method as claimed in claim 10, wherein the non-spread spectrum clock signal is a clock signal having a fixed frequency.

12. The operating method as claimed in claim 9, further comprising:

adopting, by the control timing generating circuit, a time point of an edge of a current pulse of a data enabling signal as the first reference time point, wherein each of a plurality of pulses of the data enabling signal is adopted to indicate a timing of a line having a plurality of pixel data.

13. The operating method as claimed in claim 12, further comprising:

starting timing from the first reference time point by the control timing generating circuit according to the first clock signal, so as to determine a time point of a leading edge of the current line pulse of the scan reference signal.

14. The operating method as claimed in claim 12, further comprising:

starting timing from a time point of an edge of a prior pulse of the data enabling signal by the control timing generating circuit, so as to determine a time point of a leading edge of the current line pulse of the scan reference signal.

15. The operating method as claimed in claim 9, wherein the second reference time point corresponds to a time point of a leading edge of a valid data period of a data line of the display panel.

16. The operating method as claimed in claim 15, wherein the time point of the trailing edge of the current line pulse falls within the valid data period of the data line.

* * * * *